US005198720A

United States Patent [19]

Choi

[11] Patent Number: 5,198,720

[45] Date of Patent: Mar. 30, 1993

[54] DIRECT HEATING CATHODE STRUCTURE FOR CATHODE RAY TUBES

[75] Inventor: Kyeong-seok Choi, Ulsan, Rep. of Korea

[73] Assignee: Samsung Electron Devices Co., Ltd., Kyunggi, Rep. of Korea

[21] Appl. No.: 799,150

[22] Filed: Nov. 27, 1991

[30] Foreign Application Priority Data

Nov. 27, 1990 [KR] Rep. of Korea ..... 90-18365

[51] Int. Cl.[5] ..... H01J 29/04; H01J 1/18

[52] U.S. Cl. ..... 313/446; 313/271; 313/341; 313/344; 313/456

[58] Field of Search ..... 313/446, 456, 344, 310, 313/277, 271, 341

[56] References Cited

U.S. PATENT DOCUMENTS 3,069,584 12/1962 Frazer ..... 313/341
3,092,748 6/1963 Dickson, Jr. et al. ..... 313/341 X
4,388,551 6/1983 Ray ..... 313/341 X

*Primary Examiner*—Palmer C. DeMeo
*Attorney, Agent, or Firm*—Leydig, Voit & Mayer

[57] ABSTRACT

A direct heating cathode structure for a miniature cathode ray tube is disclosed wherein angular rod-shaped supports where the coiled heater is welded are bent so that one edge thereof is directed upward, and opposing delta welding portions are formed by chamfering the top edge of the bent front part of the supports, thereby allowing simple ascertainment of the proper welding location and rapid precision welding of the coiled heater.

4 Claims, 2 Drawing Sheets

DIRECT HEATING CATHODE STRUCTURE FOR CATHODE RAY TUBES

BACKGROUND OF THE INVENTION

The present invention relates to a direct heating cathode structure for miniature cathode ray tubes, and particularly to a direct heating cathode structure for cathode ray tubes which improves the welding precision of a support for a coiled heater.

FIGS. 1 and 2 show an ordinary direct heating cathode structure mounted to an electron capable of producing an electron flow which reduces picture output time with lower power consumption. The cathode structure comprises an insulator 10 having a passing hole 10*a* at its center, a pair of inverted-L- shaped supports 11 secured on insulator 10 at a certain distance apart, and a coiled heater 12 with both ends welded onto the top of supports 11. The heater is coated with an electron emitting material.

Since the conventional direct heating cathode structure for cathode ray tubes has flat-topped supports 11 with heater 12 coiled into a small diameter and welded thereon, it is difficult to precisely weld coiled heater 12 onto the center of the tops of supports 11. If coiled heater 12 is off-center when welded to the tops of supports 11 and then mounted to an electron gun, the relative positions of the heater and a corresponding electrode are incorrect, making the thermions emitted from the electron emitting material coated on the heater difficult to control normally by an electron gun electrode. This improper positioning of the heater results in a poor cut-off emission characteristic of the electrode of the electron gun making control of thermions further difficult.

To solve this problem, according to the conventional method, welding is performed with a microscope for greater precision. This requires a rigid manufacturing process. However, this precision welding method of the heater delays the manufacturing process, resulting in low productivity. Further, since the precision welding of the heater depends on the naked eyes and fatigues a worker, the desired result is not easily obtained.

SUMMARY OF THE INVENTION

Therefore, it is an object of the present invention to provide a direct heating cathode structure for cathode ray tubes having an improved structure which facilitates the control of precision welding of a heater welded onto its support.

To accomplish the object, there is provided a direct heating cathode structure for a miniature cathode ray tube comprising an insulator having a pair of supports secured thereon at a certain distance apart, and a coiled heater in which both ends thereof are welded onto the opposing welding portions of the supports, wherein the supports are made of polygonal rods and which are bent so that one edge is positioned centrally and higher than other edges. The leading part of the centrally positioned edge of the bent supports is chamfered to provide a delta shaped planer welding portion which is substantially parallel with the insulator.

Here, supports in the form of a square cross-sectioned rods are advantageous in manufacturing. The front of each support is bent to have a predetermined angle of inclination with the insulator so as to be directed slightly upward. In other words, the front portion of the body of each support is bent to an angle less than 90° so that the angle between the lower part secured on the insulator and the front bent part is greater than 90°. The delta welding portion is provided by chamfering the top edge of the bent front to be parallel with the insulator.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
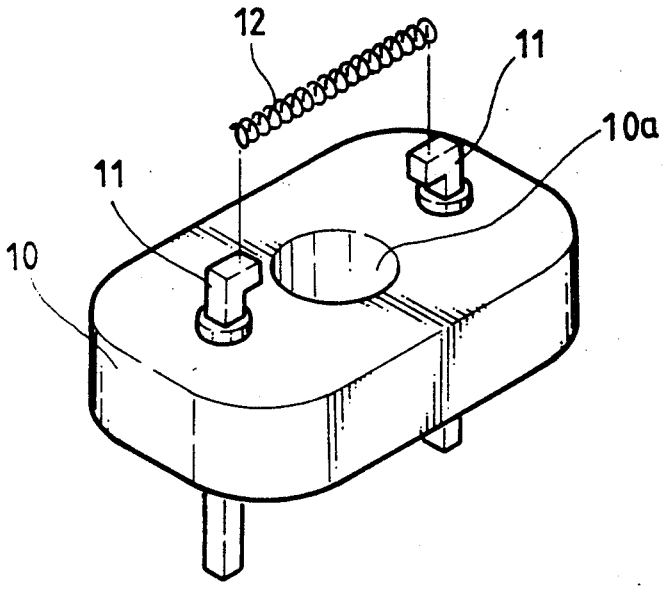
FIG.1(PRIOR ART)
FIG. 1 is an exploded perspective view of a conventional direct heating cathode structure for miniature cathode ray tubes.
Figure 2:
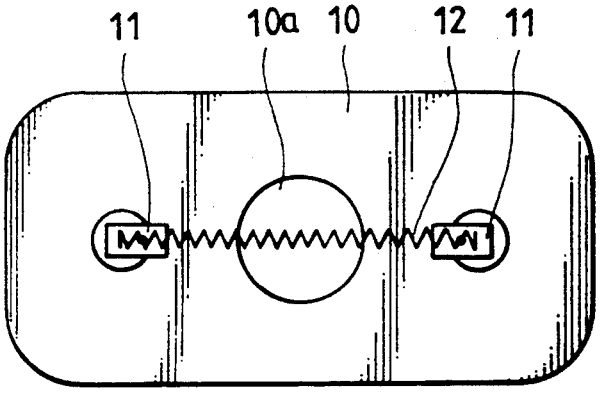
FIG.2(PRIOR ART)
FIG. 2 is a plan view of the conventional cathode structure of FIG. 1.
Figure 3:
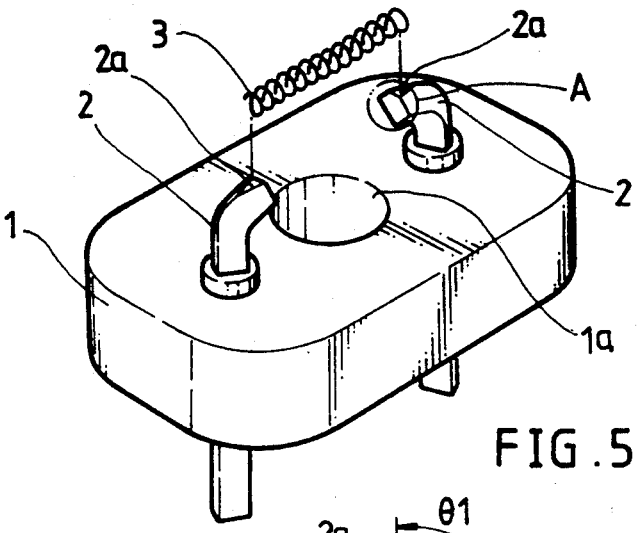
FIG. 3 is an exploded view of a direct heating cathode structure for miniature cathode ray tubes according to the present invention.
Figure 4:
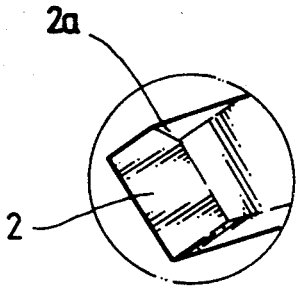
FIG. 4 is an enlarged view of portion A of FIG. 3.
Figure 5:
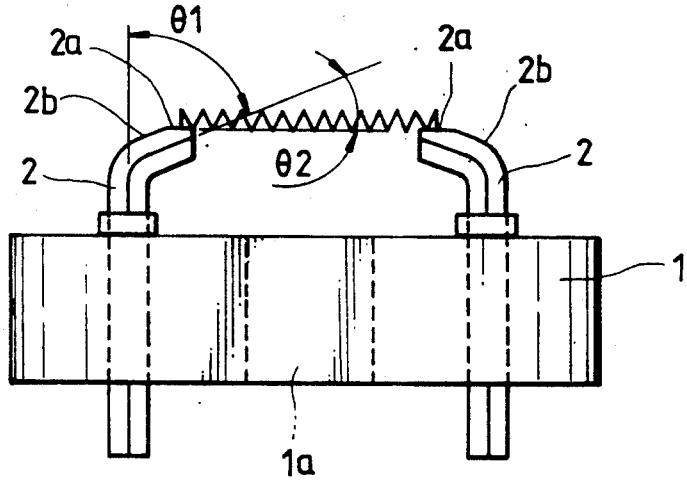
FIG. 5 is a front elevation of the cathode structure of FIG. 3.

Referring to FIG. 3, a direct heating cathode structure for a miniature cathode ray tube comprises an insulator 1 having a vertical passing hole 1*a* at the center thereof, a pair of inverted-L-shaped supports 2 formed of square rods and secured onto insulator 1 at a certain distance apart, and a coiled heater 3 with both ends welded onto the opposing welding portions 2*a* of supports 2. The heater is coated with an electron emitting material. The square rod supports 2 are bent into the form of an inverted "L". With one edge 2*b* of supports 2 positioned centrally and highly with respect to other edges, the leading portion of the central top edge 2*b* is chamfered to provide a planar delta welding portion 2*a*. The plane created by welding 2*a* is parallel with the surface of insulator 1, and is substantially on the same level.

A more detailed description of the supports is as follows.

The L-shaped square supports 2 where the welding portions 2*a* are provided are bent to an angle $\theta 1$ less than 90°. Then, the top edges of the bent front parts of the supports are chamfered so as to be parallel with the surface of the insulator, thereby providing the planar delta welding portions 2*a* which keep angle $\theta 2$ against the bent front part. This allows the two delta welding portions 2*a* which are parallel with the insulator, to be substantially on the same level.

Figure 6:
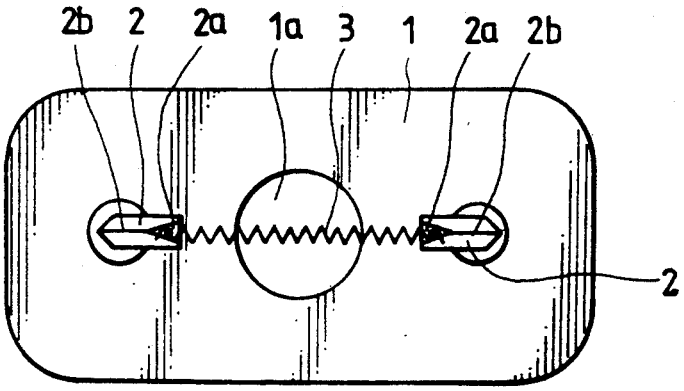
FIG. 6 is a plan view of the cathode structure of FIG. 3.

When welding coiled heater 3 on heater welding portion 2*a* according to the direct heating cathode structure for a miniature cathode ray tube of the present invention, as shown in FIG. 6, supports 2 where coiled heater 3 is welded are bent so that top edge 2*b* is directed upward, and the delta heater welding portions 2*a* formed by chamfering top edge 2*b* to be parallel with the surface of insulator 1, are opposingly formed. This allows the welding centers to be ascertained by the naked eye because of the remaining part of edge 2*b* which is not machined. This allows for rapid and precise welding of the heater by simple positioning on the welding portion. Further, since the area of the welding portions 2*a* is narrower than the conventional one, the potential for any offset of the relative position of the heater from the center of supports 2 is greatly reduced which realizes more precise welding.

The type of rod used as the supports in this specification is not be restricted to having a square cross section. The support rod may be trianglular, pentagonal or hexagonal.

As described above in detail, according to the direct heating cathode structure for a miniature cathode ray tube of the present invention, angular rod-shaped supports where the coiled heater is welded are bent so that one edge thereof is directed upward, and the opposing delta welding portions are formed by chamfering the top edge of the bent front part of the supports, thereby allowing simple ascertainment of the proper welding location and rapid precision welding of the coiled heater.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. A direct heating cathode structure for a miniature cathode ray tube comprising an insulator having a pair of supports secured thereon at a certain distance apart, and a coiled heater in which both ends thereof are welded onto opposing welding portions of said supports, wherein said supports are made of polygonal rods which are bent such that one edge is positioned centrally and higher than other edges, and the leading part of the centrally positioned edge is chamfered to provide a delta-shaped planar welding portion which is substantially parallel with said insulator.

2. A direct heating cathode structure for a miniature cathode ray tube as claimed in claim 1, wherein said supports are made of square cross-sectioned rods.

3. A direct heating cathode structure for a miniature cathode ray tube as claimed in claim 1, wherein the front of said supports is bent so that the angle between the lower part of said supports secured on said insulator and the front bent part thereof is greater than 90°.

4. A direct heating cathode structure for a miniature cathode ray tube as claimed in claim 2, wherein the front of said supports is bent so that the angle between the lower part secured on said insulator and the front bent part is greater than 90°.

* * * * *